US012735162B1

(12) United States Patent
Amerling et al.

(10) Patent No.: US 12,735,162 B1
(45) Date of Patent: Sep. 15, 2026

(54) OUTBOARD MARINE DRIVES AND COWLINGS FOR OUTBOARD MARINE DRIVES HAVING WATER MANAGEMENT

(71) Applicant: Brunswick Corporation, Mettawa, IL (US)

(72) Inventors: Steven J. Amerling, Fond du Lac, WI (US); Keith W. Schmidt, Stillwater, OK (US); David B. Griep, Rubicon, WI (US); Duane Harding, Stillwater, OK (US); Daniel A. Roske, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 613 days.

(21) Appl. No.: 18/195,691

(22) Filed: May 10, 2023

Related U.S. Application Data

(60) Provisional application No. 63/424,708, filed on Nov. 11, 2022.

(51) Int. Cl.
*B63H 20/32* (2006.01)

(52) U.S. Cl.
CPC ..... *B63H 20/32* (2013.01)

(58) Field of Classification Search
CPC ..... B63H 20/32
See application file for complete search history.

(56) References Cited

U.S. PATENT DOCUMENTS 3,953,053 A 4/1976 Arenhold
4,379,702 A * 4/1983 Takada ..... F02M 35/168 123/195 P
4,505,010 A 3/1985 Arenhold
4,781,634 A 11/1988 Harris
5,052,960 A * 10/1991 Kato ..... F02B 75/22 440/88 R
5,328,395 A * 7/1994 Oishi ..... F02B 61/045 123/195 P
5,573,436 A * 11/1996 Trudeau ..... F02M 35/168 440/77
5,967,865 A * 10/1999 Nakamura ..... B63H 20/34 440/52
6,287,161 B1 * 9/2001 Nozawa ..... B63H 20/32 440/77
7,247,065 B2 * 7/2007 Ito ..... F02M 35/168 440/77
7,390,232 B1 6/2008 English et al.
7,524,223 B2 * 4/2009 Ochiai ..... F02B 61/045 440/88 N (Continued)

OTHER PUBLICATIONS

Office Action issued in U.S. Appl. No. 18/195,691, dated Nov. 7, 2025.

*Primary Examiner* — Marc Q Jimenez
*Assistant Examiner* — Jovon E Hayes
(74) *Attorney, Agent, or Firm* — Andrus Intellectual Property Law, LLP

(57) ABSTRACT

A cowling is for an outboard marine drive. The cowling has a top cowl defining a cowling interior, a lid on the top cowl, the lid being movable (e.g. pivotable or slidable) into and between an open position providing access to the cowling interior and a closed position enclosing the cowling interior, and a trough system located below the lid, the trough system being configured to drain water by gravity from the lid and the top cowl.

30 Claims, 9 Drawing Sheets

(56) References Cited

U.S. PATENT DOCUMENTS

| | | | | |
|---|---|---|---|---|
| 8,651,906 | B1 * | 2/2014 | Morton | B63H 20/32 440/88 R |
| 9,017,121 | B1 | 4/2015 | Amerling | |
| 9,216,805 | B1 | 12/2015 | Amerling et al. | |
| 9,341,008 | B1 * | 5/2016 | Amerling | B63H 20/32 |
| 9,463,859 | B1 * | 10/2016 | Cooper, III | B63H 20/002 |
| 9,580,943 | B1 | 2/2017 | Amerling et al. | |
| 9,580,947 | B1 | 2/2017 | Amerling et al. | |
| 9,963,213 | B1 | 5/2018 | Jaszewski et al. | |
| 10,005,534 | B1 * | 6/2018 | Amerling | B63H 20/32 |
| 10,150,549 | B1 | 12/2018 | Amerling et al. | |
| 10,202,180 | B1 | 2/2019 | Amerling et al. | |
| 10,286,989 | B1 | 5/2019 | Amerling et al. | |
| 10,336,429 | B1 * | 7/2019 | Amerling | F02M 35/1233 |
| 10,351,222 | B1 | 7/2019 | Amerling et al. | |
| 10,464,648 | B1 | 11/2019 | Amerling et al. | |
| 10,710,691 | B2 | 7/2020 | Amerling et al. | |
| 10,718,142 | B1 | 7/2020 | Amerling et al. | |
| 11,130,555 | B1 | 9/2021 | Foulkes et al. | |
| 11,312,462 | B1 | 4/2022 | Faust et al. | |
| 11,352,116 | B1 | 6/2022 | Amerling et al. | |
| 11,486,340 | B1 * | 11/2022 | Gunderson | B63H 20/001 |
| 11,542,735 | B1 | 1/2023 | Amerling et al. | |
| 11,577,809 | B1 | 2/2023 | Faust et al. | |
| 2006/0135008 | A1 * | 6/2006 | Ito | B63H 20/285 440/77 |
| 2006/0258234 | A1 * | 11/2006 | Ito | F02M 35/168 440/77 |
| 2015/0367924 | A1 * | 12/2015 | Davis | B63H 20/24 440/53 |
| 2016/0001864 | A1 * | 1/2016 | Davis | B63H 20/24 440/53 |
| 2022/0266967 | A1 | 8/2022 | Kraus et al. | |

* cited by examiner

OUTBOARD MARINE DRIVES AND COWLINGS FOR OUTBOARD MARINE DRIVES HAVING WATER MANAGEMENT

CROSS-REFERENCE TO RELATED APPLICATION

The present application claims priority to U.S. Provisional Patent Application No. 63/424,708, filed Nov. 11, 2022, which is hereby incorporated herein by reference.

FIELD

The present disclosure relates to outboard marine drives for propelling a marine vessel in water, and particularly to cowlings on outboard marine drives having water management.

BACKGROUND

The following U.S. Patents are incorporated herein by reference in entirety:

U.S. Pat. No. 10,336,429 discloses a cowling for an outboard motor that has port and starboard intake ports that direct flow of intake air into the cowling and extend downwardly along the aftward side of the cowling and face laterally outwardly. A duct system receives and conveys intake air intake ports to an intake conduit for the outboard motor. The duct system includes port and starboard intake troughs that extend alongside the intake ports and redirect the intake air from a generally lateral flow into the intake ports to a generally vertically downward flow and then to a generally forward flow towards the intake conduit. Port and starboard baffles extend alongside the intake ports and direct flow of water into port and starboard channels located alongside the baffles, respectively. The channels drain the water by gravity depending on tilt and trim orientation of the outboard motor.

U.S. Pat. No. 7,524,223 discloses an outboard motor that is capable of reliably separating water and air sucked in from an intake port and efficiently draining the separated water. The motor can comprise a cowling, a right-side intake port, a left-side intake port, first and second water separating portions, a communication port, and an engine compartment. The right-side intake port can be formed in a right side surface portion of an upper portion of the cowling. The left-side intake port can be formed in a left side surface portion of the upper portion of the cowling. The first water separating portion can have an intake passage communicating between the right-side intake port and the left-side intake port. The second water separating portion can communicate with the first water separating portion through the communication port, and the second water separating portion can communicate with the engine compartment.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In non-limiting examples disclosed herein, a cowling may be for an outboard marine drive. The cowling may extend from a top to a bottom in an axial direction, from a front to a rear in a longitudinal direction which is perpendicular to the axial direction, and from a port side to a starboard side in a lateral direction which is perpendicular to the axial direction and perpendicular to the longitudinal direction. The cowling may include a top cowl defining a cowling interior, a lid on the top cowl, and a trough system located below the lid. The lid may be movable (e.g., pivotable or slidable) into and between an open position providing access to the cowling interior and a closed position enclosing the cowling interior. The trough system may be configured to drain water by gravity from the lid and the top cowl. The trough system may be configured to drain the water to the port side and to the starboard side of the cowling.

The top cowl may include an upper lip which is turned radially inwardly towards the cowling interior. The lid in the closed position may overlap the upper lip such that the upper lip provides a deflector for the water. The trough system may be at least partially defined by the upper lip. The trough system and the upper lip may be one piece. The lid may include a port edge portion and a starboard edge portion. The port edge portion and the starboard edge portion may overlap and may be turned downwardly towards the port side and the starboard side of the cowl, respectively, when the lid is in the closed position.

The trough system may include a port gutter located along the port side of the top cowl and a starboard gutter located along the starboard side of the top cowl. The port gutter and the starboard gutter may be configured to convey water from the lid longitudinally along the port side and the starboard side of the cowling, respectively, for removal from the cowling. The lid, the port gutter, and the starboard gutter may be sloped downwardly towards the front of the cowling such that the water drains by gravity towards the front of the cowling.

The trough system may further include a port channel which conveys water from the port gutter downwardly along the port side of the cowling and a starboard channel which conveys water from the port gutter downwardly along the starboard side of the cowling. The port channel may be connected to the port gutter along the front of the cowling and the starboard channel may be connected to the starboard gutter along the front of the cowling.

The lid may be sloped towards the front of the cowling and the trough system may include a drain gutter located at the front of the cowling. The drain gutter may be configured to convey the water from the lid to the port side and the starboard side of the cowling. The lid may include a front edge portion over which the water on the lid in the closed position drains to the drain gutter. The drain gutter may include an axially extending baffle which separates the water for conveyance to the port side and the starboard side. The top cowl may include a front panel having a rear edge which faces a front edge portion of the lid in the closed position. A gap may be defined between the rear edge and the front edge portion through which water drains to the drain gutter.

The cowling may include at least one drain hole in the front panel for draining the water from inside the cowling interior when the cowling is trimmed up about a lateral trim axis. The at least one drain hole may comprise a first drain hole for draining water from inside the cowling interior when the cowling is in a full trim position and a second drain hole for draining water from inside the cowling interior when the cowling is at least in a partial trim position. The front panel may be configured to support a display screen and the at least one drain hole may be configured to drain the water away from the display screen. The cowling may include a plurality of standoffs which support the display screen relative to an interior surface of the front panel to limit water damage to the display screen. The cowling may include a rear panel having a recess in which water collects when the cowling is trimmed up about a lateral trim axis, and further comprising a deflector surface configured to drain the water from the cowling when the cowling is steered out of a center position relative to a steering axis. The deflector surface may extend over the upper lip.

In non-limiting examples disclosed herein, an outboard marine drive may extend from a top to a bottom in an axial direction, from a front to a rear in a longitudinal direction which is perpendicular to the axial direction, and from a port side to a starboard side in a lateral direction which is perpendicular to the axial direction and perpendicular to the longitudinal direction. The outboard marine drive may be steerable about an axial steering axis and may be trimmable about a lateral trim axis. The outboard marine drive may include a cowling comprising a top cowl defining a cowling interior, a lid on the top cowl, and a trough system located below the lid. The lid may be movable (e.g., pivotable or slidable) into and between an open position providing access to the cowling interior and a closed position enclosing the cowling interior. The trough system may be configured to drain water by gravity from the lid and the top cowl.

The lid may be sloped towards the front of the cowling and the trough system may include a drain gutter located at the front of the cowling. The drain gutter may be configured to convey the water from the lid to the port side and the starboard side of the cowling. The top cowl may include a front panel having a rear edge which faces a front edge portion of the lid in the closed position. A gap may be defined between the rear edge and the front edge portion through which water drains to the drain gutter. The outboard marine drive may include at least one drain hole in the front panel for draining the water from inside the cowling interior when the cowling is trimmed up about a lateral trim axis. A display screen may be supported on the front panel, and the at least one drain hole may be configured to drain the water away from the display screen.

The top cowl may include an upper lip which is turned radially inwardly towards the cowling interior. The lid in the closed position may overlap the upper lip such that the upper lip provides a deflector for the water. The marine drive may further include a torpedo housing for supporting a propulsor, and a lower cowl located between the top cowl and the torpedo housing. The lower cowl may include at least one drain hole for draining water from inside the lower cowl. The outboard marine drive may further include and a splash plate extending around the lower cowl.

BRIEF DESCRIPTION OF THE DRAWINGS

The present disclosure includes the following Figures.

DETAILED DESCRIPTION

Figure 1:
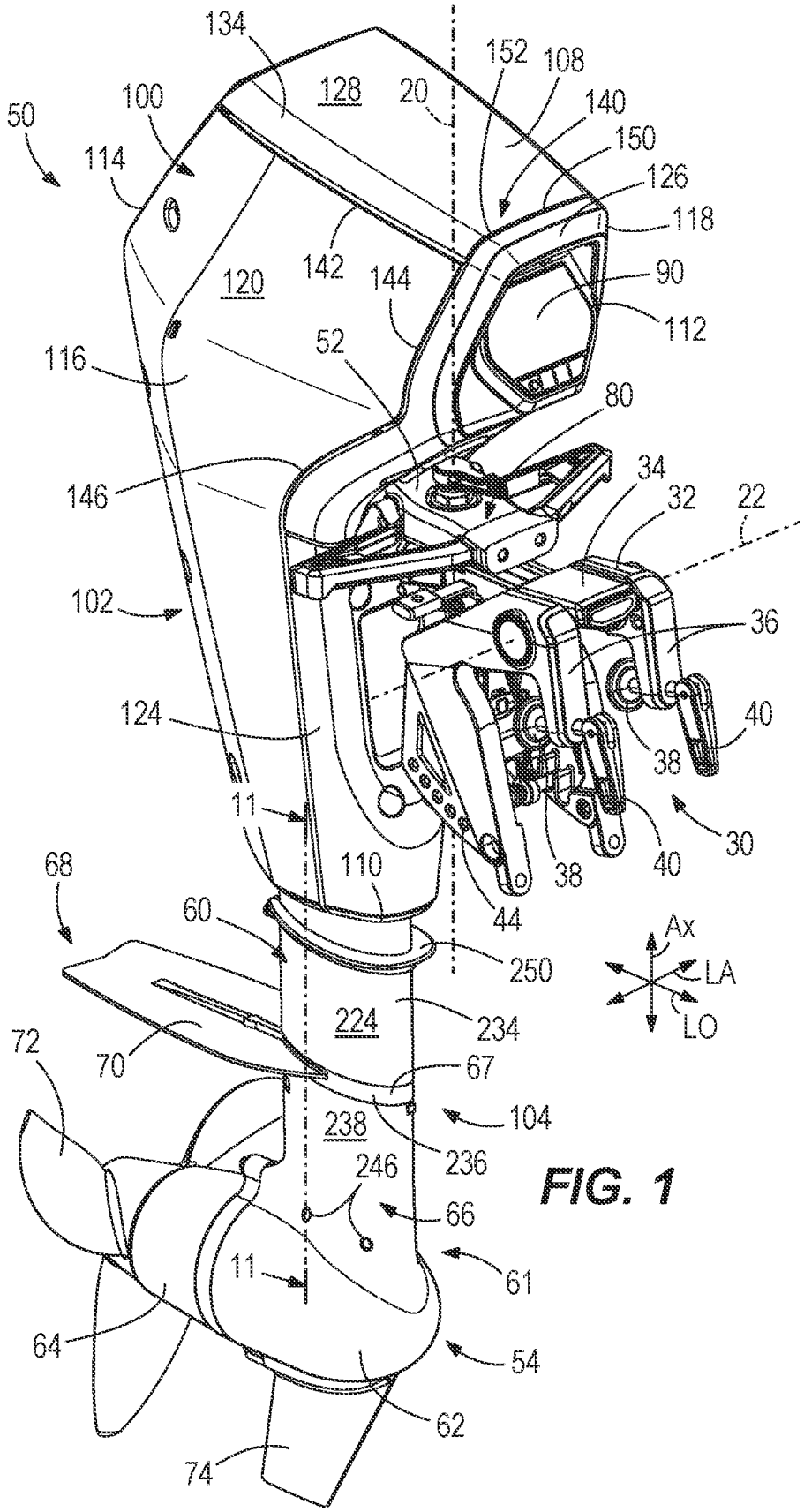
FIG. 1 is a perspective view of a marine drive supported on a transom bracket assembly.

FIG. 1 depicts a marine drive 50 for propelling a marine vessel in a body of water. In the illustrated embodiment, the marine drive 50 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. A transom bracket assembly 30 supports the marine drive 50 on the transom (not shown) of the marine vessel such that the marine drive 50 is trimmable up and down relative to the transom bracket assembly 30, including in non-limiting examples wherein the marine drive 50 is raised completely out of the water.

Figure 11:
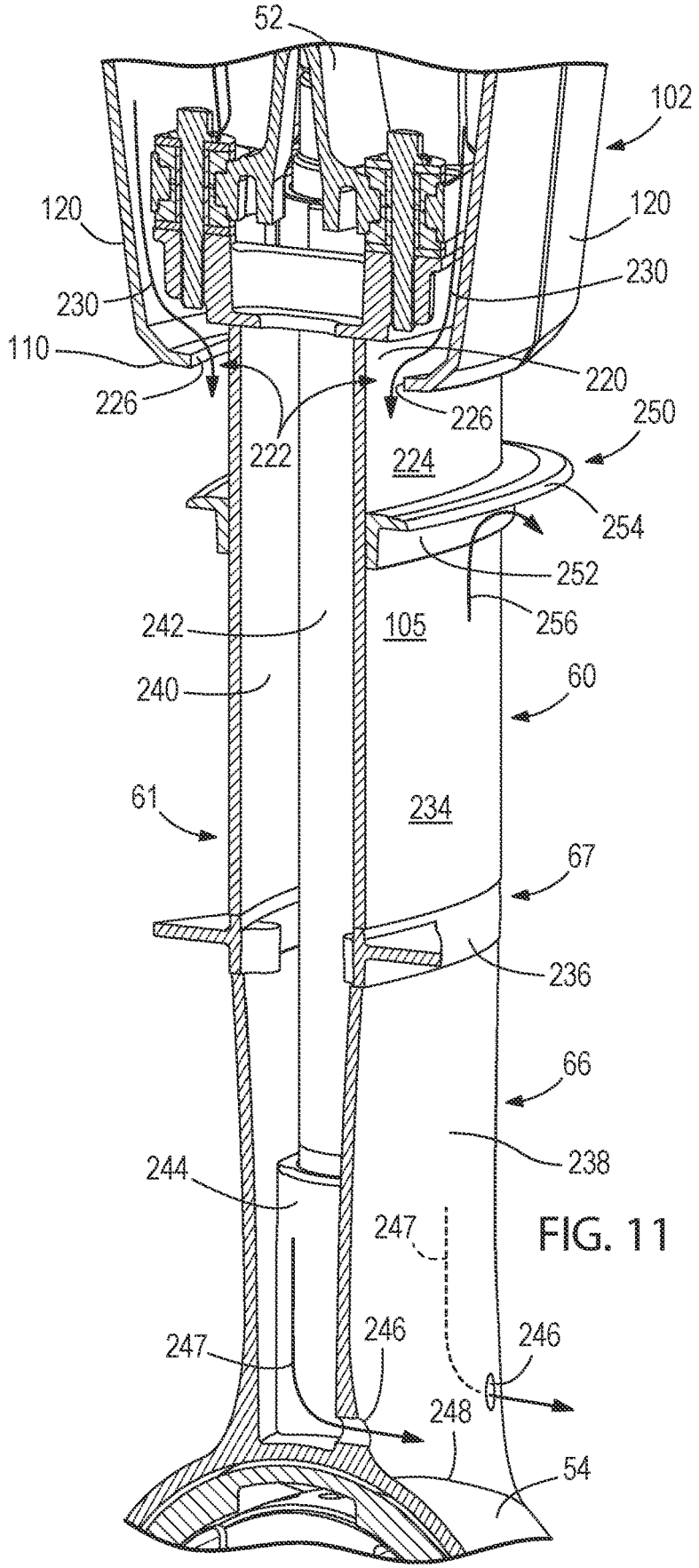
FIG. 11 is a view of section 11-11, taken in FIG. 1.

The marine drive 50 includes a supporting frame 52 (lower end shown in FIG. 11) for rigidly supporting the various components of the marine drive 50 with respect to the marine vessel and a lower unit 61 supported by the supporting frame 52. The supporting frame 52 has body (not shown) and a support leg extending downwardly from the bottom of the body. A lower end of the support leg is coupled to the lower unit 61 of the marine drive 50, which generally includes a torpedo housing 54, a stem 66, an extension leg 60, and an anti-ventilation plate 68 disposed between the stem 66 and the extension leg 60. The anti-ventilation plate 68 has a head 67 positioned between the extension leg 60 and the stem 66 and includes a generally flat anti-cavitation plate 70 that extends rearwardly from the extension leg 60. As discussed in further detail below, the extension leg, 60, the head 67 of the anti-ventilation plate 68, and the stem 66 generally form a lower cowl 104 that is supported by the supporting frame 52.

The torpedo housing 54 has a front housing portion 62 and a rear housing portion 64 which are mated together and define a watertight lower housing cavity for containing a motor (not shown) and related componentry. The front housing portion 62 has a nosecone with a smooth outer surface which transitions to the upwardly extending stem 66 and a downwardly extending skeg 74. A conventional propulsor 72 is mounted on the outer end of a propulsor shaft extending from the torpedo housing 54 such that rotation of the propulsor shaft by the motor causes rotation of the propulsor 72, which in turn generates a thrust force for propelling the marine vessel in water. It should be understood that the various components described above are exemplary and could vary from what is shown.

With continued reference to FIG. 1, the marine drive 50 is coupled to the transom (not shown) of a marine vessel by a transom bracket assembly 30, which in the illustrated example includes a transom bracket 32 configured to be fixed to the transom and a swivel bracket 34 pivotably coupled to the transom bracket 32. The transom bracket 32 has a pair of C-shaped arms 36 which fit over the top of the transom and a pair of threaded, plunger-style clamps 38 which clamp the C-shaped arms 36 to the transom. Rotation of handles 40 in one direction clamps the transom between the C-shaped arms 36 and plunger-style clamps 38. Rotation of the handles 40 in the opposite direction frees the C-shaped arms 36 for removal from the transom. In some embodiments, the transom bracket 32 is additionally or alternatively fixed to the transom by at least one fastener (not shown).

The swivel bracket 34 is pivotable with respect to the C-shaped arms 36 about a pivot shaft that laterally extends through the forward upper ends of the C-shaped arms 36, thereby defining a trim axis 22. Pivoting of the swivel bracket 34 about the pivot shaft trims the marine drive 50 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the marine drive 50. A selector pin (not shown) can be manually inserted into the aligned holes to thereby lock the marine drive 50 in place with respect to the trim axis 22.

The marine drive 50 is supported on the swivel bracket 34 by a steering arm 80, which extends from the body (not shown) of the supporting frame 52 of the marine drive 50, generally along the midsection of the marine drive 50. A swivel tube assembly (not shown) extends transversely from the steering arm 80 and is removably received in a swivel cylinder (not shown) of the swivel bracket 34. The marine drive 50 can be steered left or right relative to the marine vessel by rotating about the steering axis 20, which is defined by the swivel tube and swivel cylinder, via a manually operable tiller (not shown) and/or any other known apparatus for steering a marine drive with respect to a marine vessel.

In the illustrated embodiments, the marine drive 50 includes a cowling 100 with a top cowl 102 and a lower cowl 104. The cowling 100 extends from a top 108 to a bottom 110 in an axial direction, from a front 112 to a rear 114 in a longitudinal direction which is perpendicular to the axial direction, and from a starboard side 116 to a port side 118 in a lateral direction which is perpendicular to the axial direction and perpendicular to the longitudinal direction. The top cowl 102 includes a plurality of cowl panels 120, 122, 124 and defines a cowling interior 106 in which a portion of the supporting frame 52 is enclosed and various components of the marine drive 50 are disposed. In the illustrated embodiments, the top cowl 102 includes starboard and port side panels 120, a rear panel 122, a lower front panel 124, an upper front panel 126. The upper front panel 126 is configured to support a display screen 90. A lid 128 is positioned on the top cowl 102 and is movable (in the illustrated example, pivotable) into and between an open and closed position. In the open position, the lid provides access to the cowling interior 106 through an opening 130 into the cowling interior 106. In the closed position, the lid 128 encloses the cowling interior 106. Additionally or alternatively, the lid 128 may be configured as a sliding lid that is configured to slide on the top cowl 102 into and between the open position and the closed position.

Figure 3:
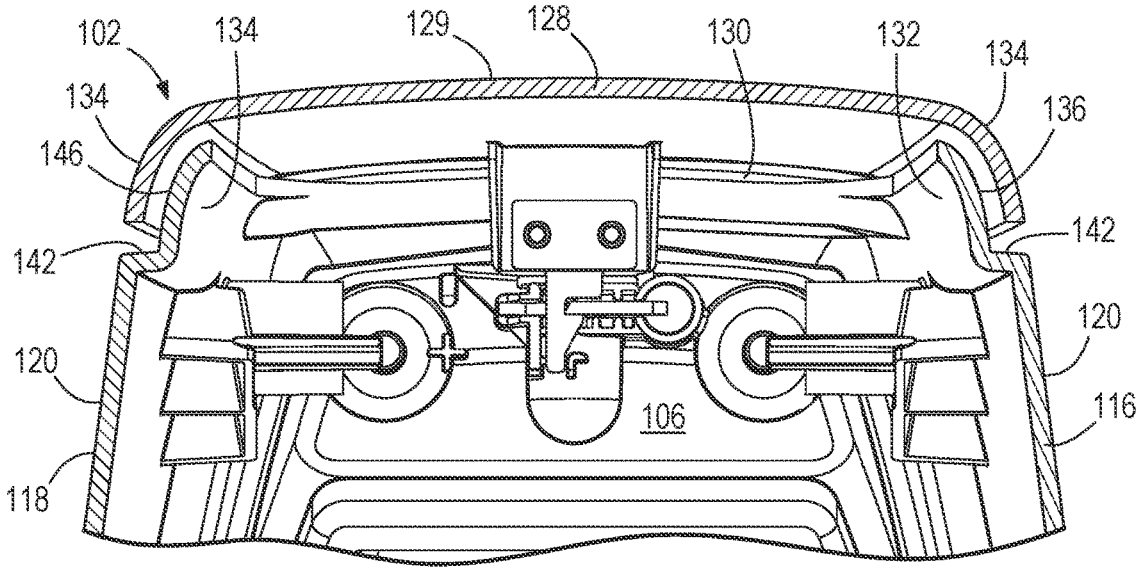
FIG. 3 is a view of section 3-3, taken in FIG. 2.
Figure 4:
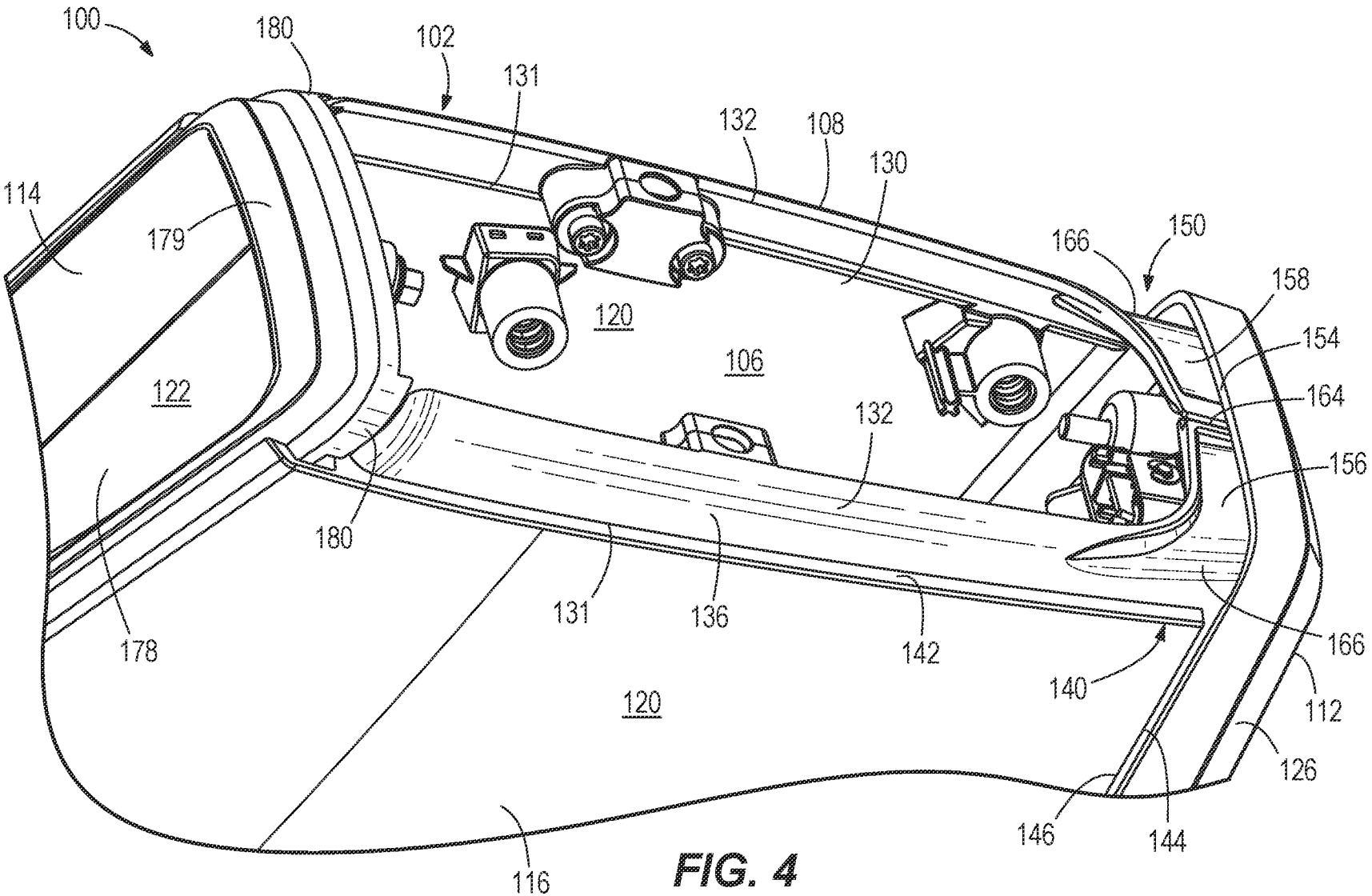
FIG. 4 is a detailed perspective view of the top cowl for the marine drive of FIG. 2 with the lid removed.
Figure 5:
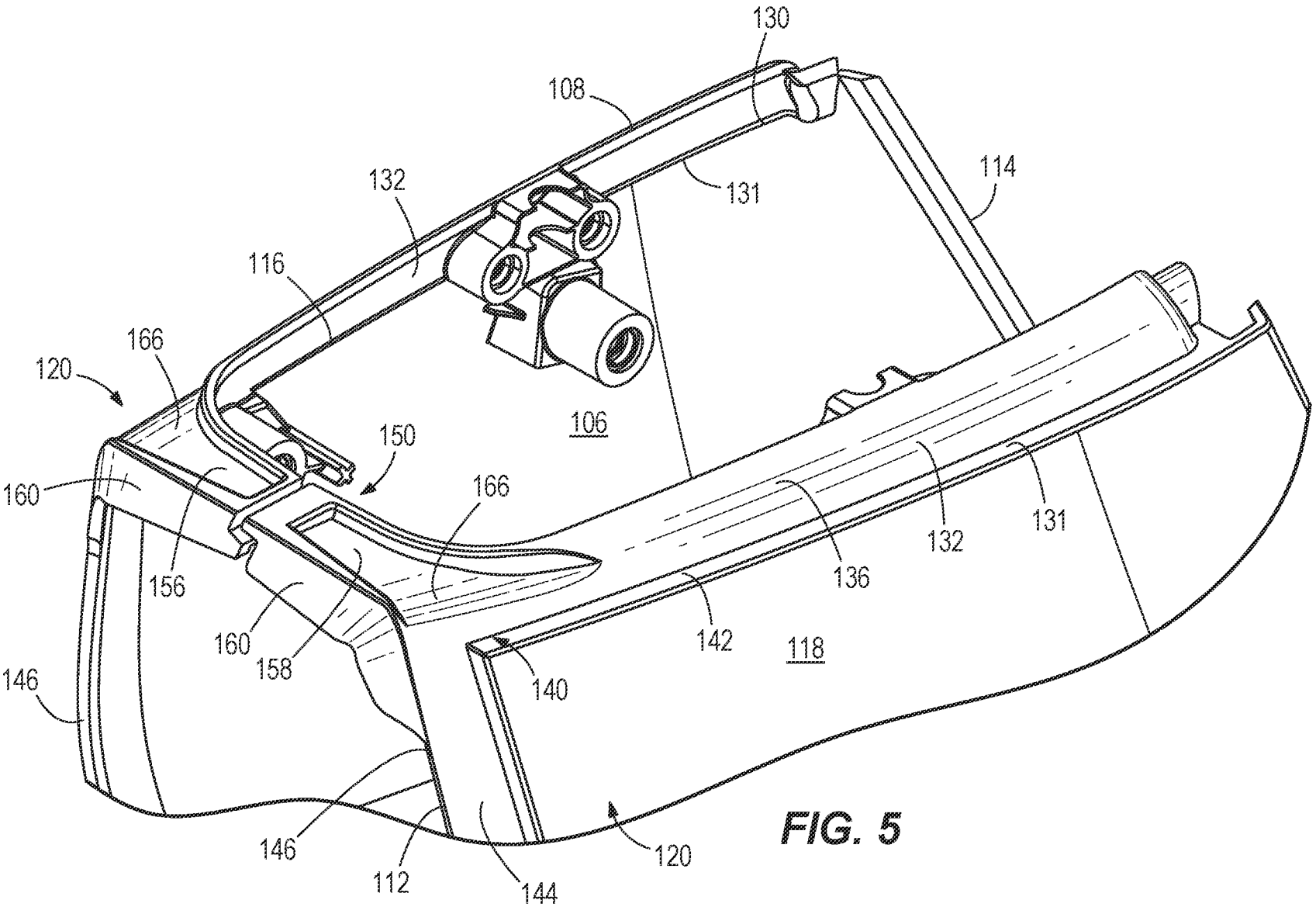
FIG. 5 is a detailed perspective view of the side cowling panels of the top cowl of FIG. 4.

Referring to FIGS. 3-5, the top cowl 102 includes an upper lip 132 extending along an upper edge 131 of the side panels 120. The upper lip 132 is offset laterally inwards from the outer surfaces of the side panels 120 and turns radially inwardly towards the cowling interior 106. As best illustrated in FIG. 3, when in the closed position, the lid 128 overlaps the upper lip 132. In particular, the illustrated lid 128 includes opposite port and starboard edge portions 134 that overlap and are turned downwardly towards the starboard side 116 and the port side 118 of the top cowl 102, respectively. Thus, the upper lip 132 provides a deflector 136 for the water configured to deflect water and restrict its flow into the cowling interior 106.

Referring to FIGS. 2-5, the cowling 100 includes a novel trough system 140 that is configured to drain water by gravity from the lid 128 and the top cowl 102. The trough system 140 is located below the lid 128 and may be at least partially defined by the upper lip 132. In the illustrated embodiments, for example, the trough system 140 and the upper lip 132 are one piece formed with the side panels 120. Some embodiments, however, may include a cowling with an upper lip and trough system that are separate parts.

On the starboard and port sides 116, 118 of the top cowl 102, the trough system 140 includes port and starboard gutters 142 configured to convey water from the lid 128 longitudinally along the starboard side 116 and the port side 118 of the cowling 100, respectively, for removal from the cowling 100. The port and starboard gutters 142 are sloped downwardly towards the front 112 of the cowling 100 such that the water drains by gravity towards the front 112 of the cowling 100 and into an axially extending channel 144. Proximate the front 112 of the cowling 100, the port and starboard gutters 142 are respectively connected to port and starboard channels 144. The channels 144 are configured to convey water from the port and starboard gutters 142 downwardly along the starboard or port side 116, 118 of the cowling 100, respectively. In the illustrated embodiments, the channels 144 extend downwardly along a front edge 146 of the side panels 120 and generally follow the contours of the front 112 of the cowling 100. Some embodiments, however, may have a port channel and/or a starboard channel that take a different downwardly route across the respective side 116, 118 of the top cowl 102.

The trough system 140 includes a drain gutter 150 located at or near the front 112 of the cowling 100. The drain gutter 150 is configured to convey water from the lid 128 to the starboard side 116 and the port side 118 of the cowling 100. The lid 128 is sloped downwards towards the front 112 of the cowling 100 and includes a front edge portion 152 over which the water on the lid 128 in the closed position drains to the drain gutter 150. The upper front panel 126 of the top cowl 102 has a rear edge 154 which faces a front edge portion 152 of the lid 128 in the closed position. A gap 148 is defined between the rear edge 154 and the front edge portion 152, and water is configured to drain from the lid 128 into the drain gutter 150 through the gap 148.

Referring to FIGS. 4 and 5, the drain gutter 150 includes a starboard section 156 and a port section 158 that are formed in laterally extending portions 160 of the port and starboard side panels 120, respectively. The starboard and port sections 156, 158 of the drain gutter 150 meet at an axially extending baffle 164 proximate a lateral midpoint of the cowling 100. The baffle 164 is configured to separate water flowing into the drain gutter 150 for conveyance to the starboard side 116 via the starboard section 156 and to the port side 118 via the port section 158. The starboard and port sections 156, 158 of the drain gutter 150 each extend laterally outward from the baffle 164 towards a respective mouth 166 that opens into the gutter 142 and channel 144 on the side panels 120.

Figure 2:
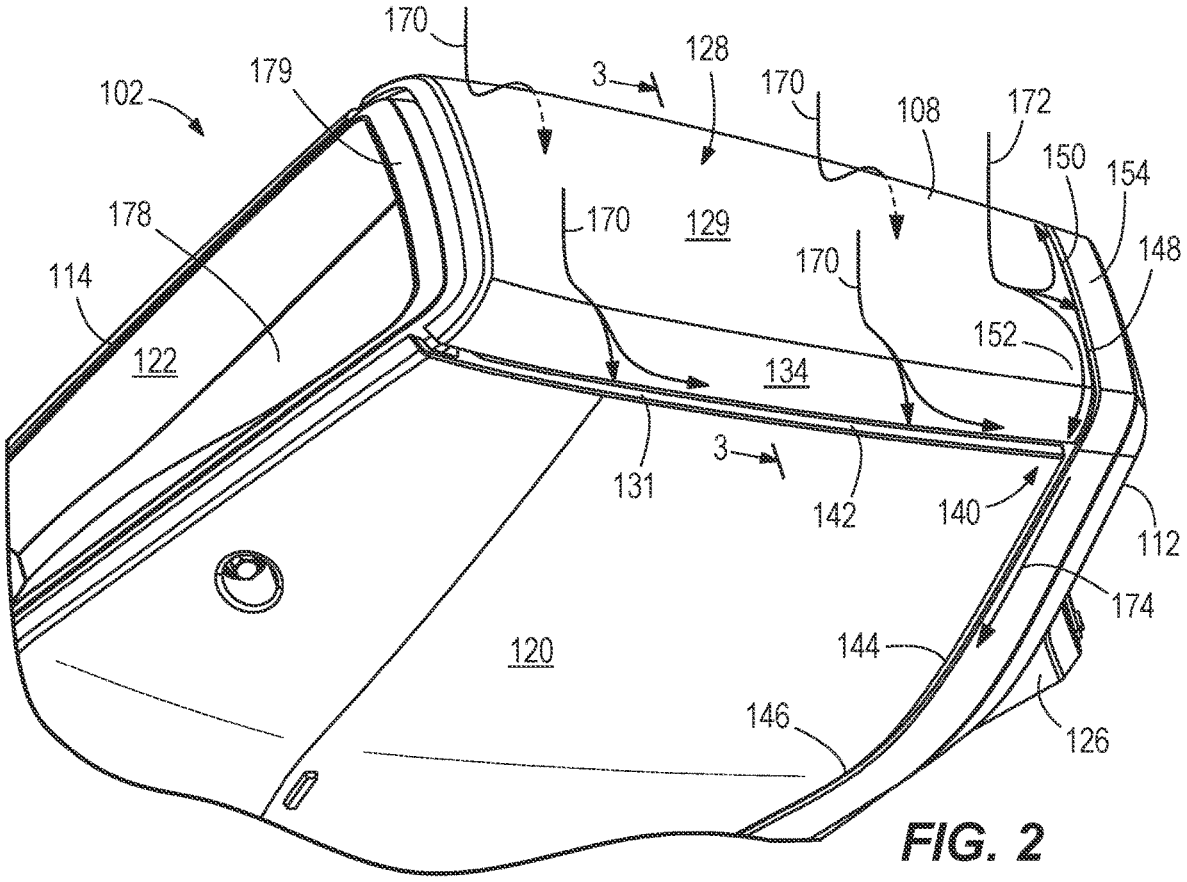
FIG. 2 is a detailed perspective view of the top cowl on the marine drive of FIG. 1.

As best illustrated in FIG. 2, the trough system 140 is configured to drain water from the top cowl 102 and the lid 128 while the marine drive 50 is trimmed down in an operating position. Due at least in part to the slope and curvature of the lid 128, water on the lid 128 is directed towards the front edge portion 152 and the port and starboard edge portions 134 of the lid 128. Water directed towards the port and starboard edge portions 134 generally follows an example flow path indicated by arrows 170 and flows laterally across a top surface 129 of the lid 128, over the respective edge portion 134, and into the gutter 142. Once the water has entered the port or starboard gutter 142, it is directed forward towards the channels 144.

Water on the lid 128 that is directed towards the front 112 of the cowling 100 generally follows an example flow path indicated by arrows 172 and flows longitudinally across the top surface 129 of the lid 128, over the front edge portion 152, and into the drain gutter 150. Water entering the drain gutter 150 through the gap 148 is separated and directed into the starboard section 156 or the port section 158 by the baffle 164. Water separated into the starboard section 156 of the drain gutter 150 flows laterally outward towards the starboard side 116 and downwards into the starboard channel 144. Water separated into the port section 158 of the drain gutter 150 flows laterally outward towards the port side 118 and downwards into the port channel 144. Water directed into the channels 144 via the longitudinally extending gutters 142 and the drain gutter 150 generally follows the example flow path indicated by arrow 174 downwardly through the channels 144 towards the bottom 110 of the top cowl 102.

Figure 6:
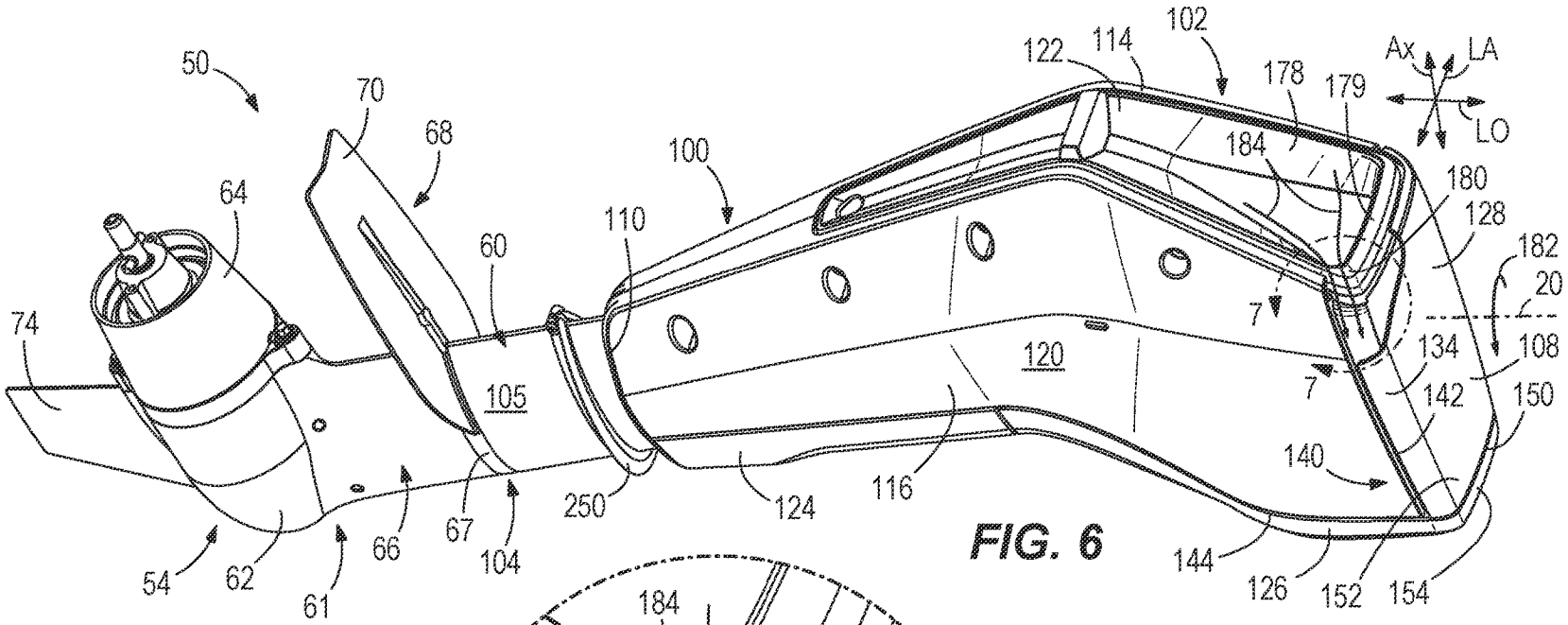
FIG. 6 is a perspective view of the marine drive of FIG. 2 with the marine drive in a trimmed-up position.
Figure 7:
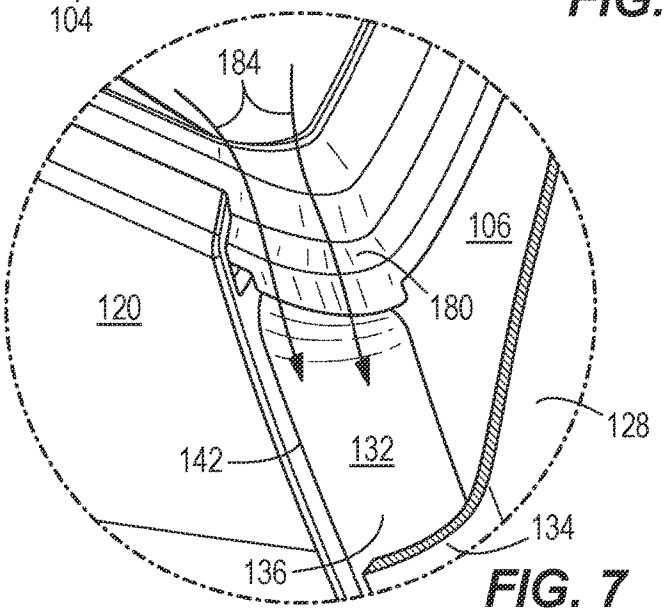
FIG. 7 is a view of section 7-7, taken in FIG. 6.

Some embodiments of a cowling 100 for a marine drive 50 may include features for draining water from the cowling 100 when the marine drive 50 and/or cowling 100 is trimmed up into a raised position in which the steering axis 20 is generally parallel to the longitudinal axis LO, as illustrated in FIG. 6. Referring to FIGS. 6 and 7, the rear panel 122 of the top cowl 102 has a recess 178 configured as a grab area that may be used to manually tilt the marine drive 50 and/or cowling 100. For example, a user may grasp and pull on the upper edge 179 of the recess 178 to pivot the marine drive upward about the axis 22. When the cowling 100 is trimmed up about the lateral trim axis 22, water may collect in the recess 178. The rear panel 122 includes a deflector surface 180 configured to drain the water from the cowling 100 when the cowling 100 is steered out of a center position relative to the steering axis 20. For example, as illustrated in FIG. 6, the cowling 100 is rotated counterclockwise about the steering axis 20 in the direction of arrow 182 to drain the water towards the starboard side 116. The marine drive 50 may alternatively by rotated in the opposite clockwise direction about the steering axis 20 to drain the water towards the port side 118.

The deflector surface 180 extends over the upper lip 132 of the top cowl 102 such that water flowing over the deflector surface 180 from the recess 178 generally follows the example flow path indicated by arrows 184 into the port or starboard gutter 142. The overlap between the deflector surface 180 and the upper lip 132 may help to reduce the flow of water into the cowling interior 106 of the cowling 100. The gutters 142, which are oriented vertically when the cowling 100 is trimmed up, may then direct the water downwardly towards the front 112 of the cowling 100.

Figure 8:
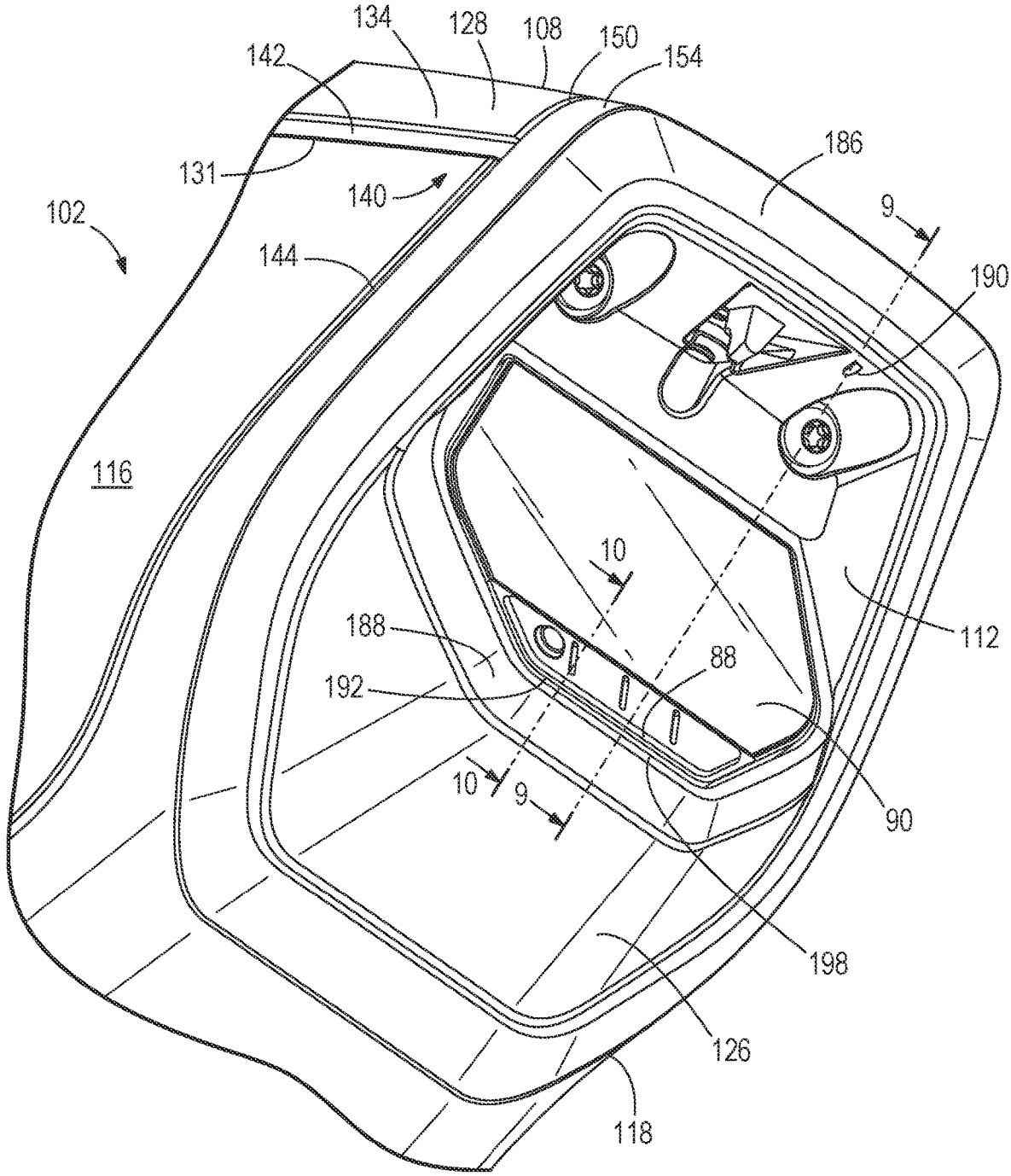
FIG. 8 is a is a detailed perspective view of the front cowl panel on the marine drive of FIG. 6.

Embodiments of a cowling 100 may include at least one of the front panels 124, 126 may include at least one drain hole 190, 192 draining water from the cowling interior 106 of the cowling 100 when the cowling is trimmed up about the trim axis 22. For example, referring to FIGS. 8-10, the upper front panel 126 includes two drain holes 190, 192 for draining the water from inside the cowling interior 106 when the cowling 100 is trimmed up about the lateral trim axis 22. The upper front panel 126 includes two sumps 186, 188 configured to collect water that has entered the cowling interior 106. A first sump 188 is located below and adjacent the display screen 90 and a second sump 188 is located proximate the top 108 of the cowling 100.

Figure 9:
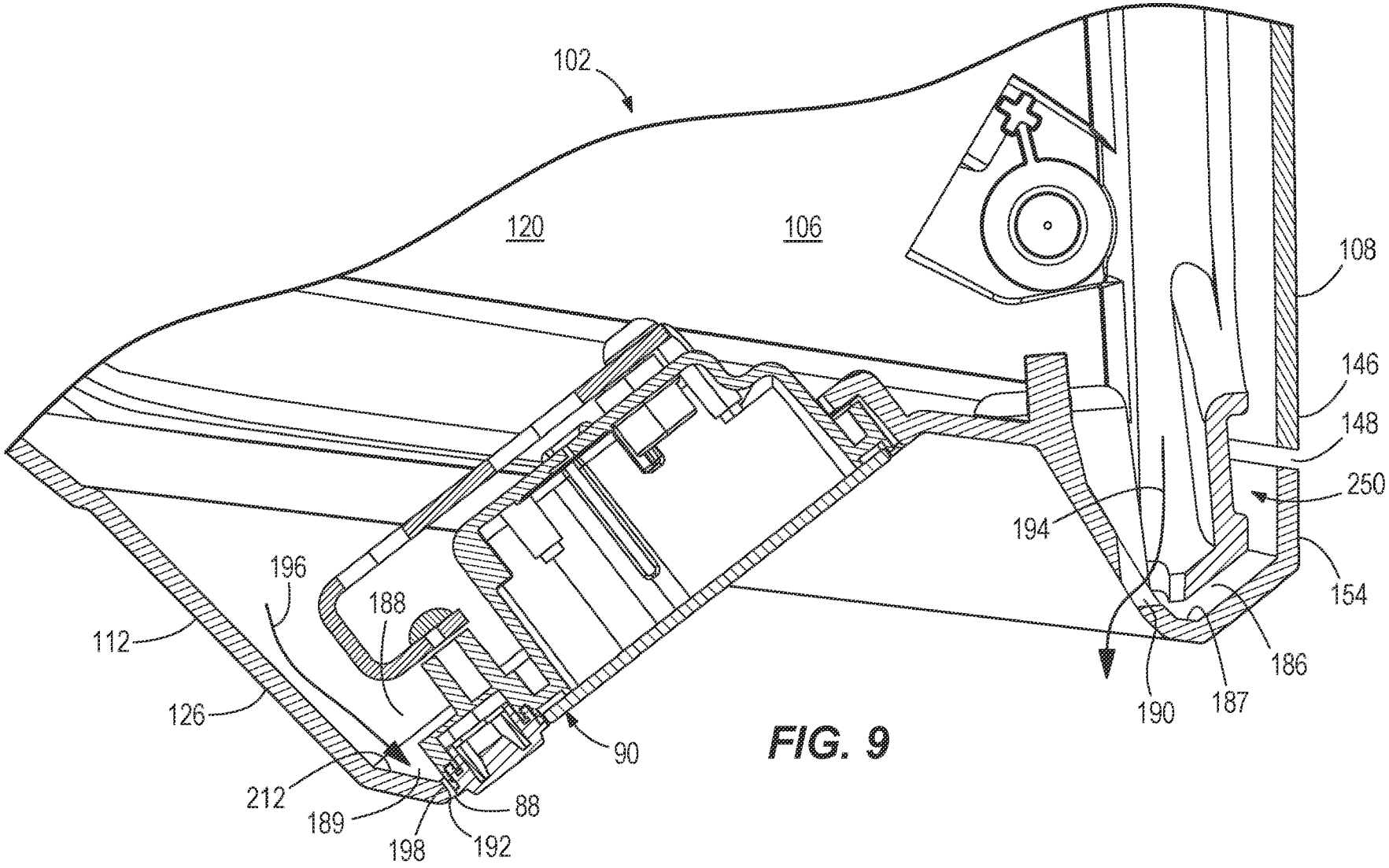
FIG. 9 is a view of section 9-9, taken in FIG. 8.

As best illustrated in FIG. 9, a first drain hole 190 is formed through the upper front panel 126 proximate the bottom 187 of the first sump 186. The first drain hole 190 provides a passage between the interior of the cowling and the exterior and is configured to drain water that collects in the first sump 186 along the example flow path indicated by arrow 194.

Figure 10:
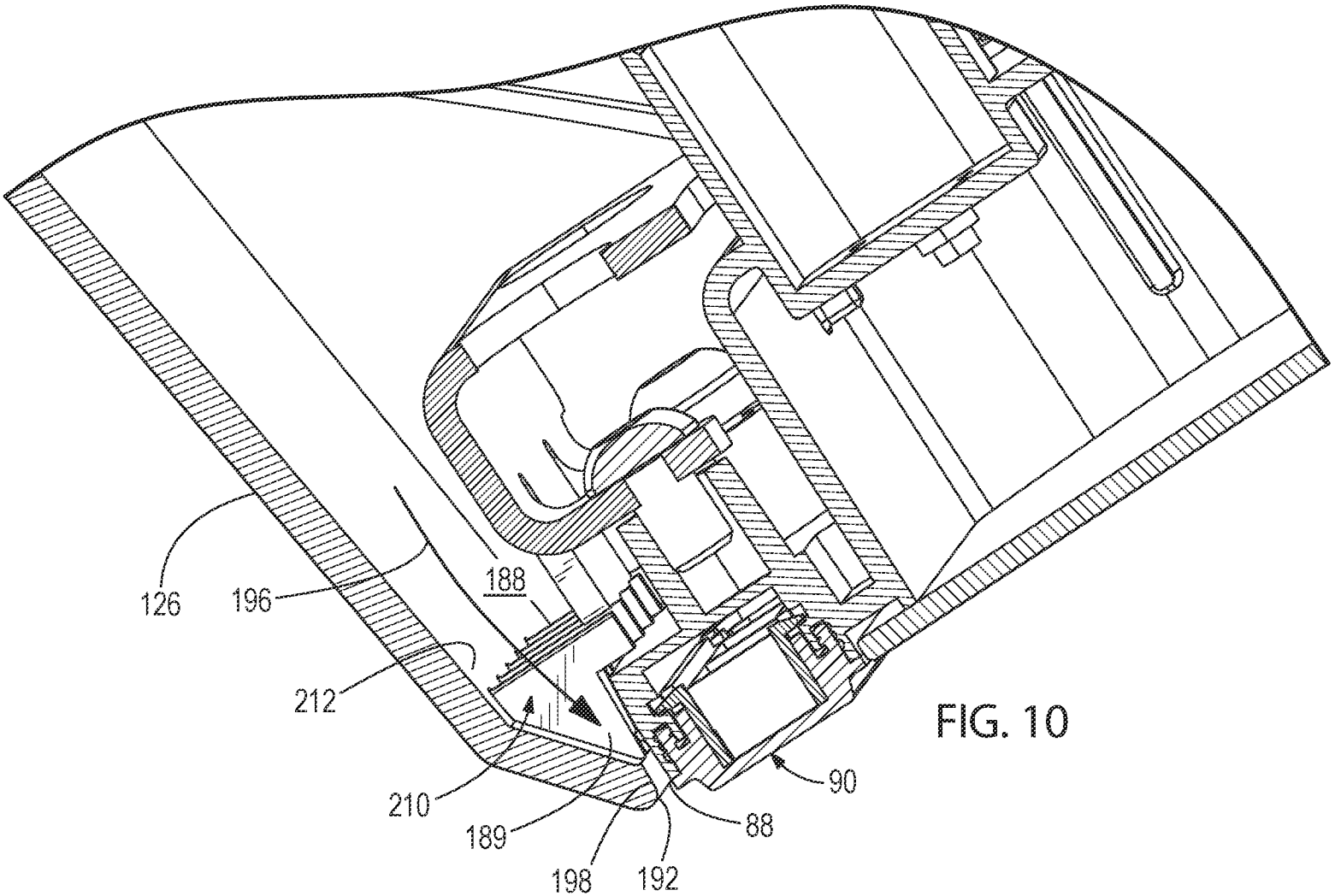
FIG. 10 is a view of section 10-10, taken in FIG. 8.

A second drain hole 192 is formed through the upper front panel 126 proximate the bottom 189 of the second sump 188. In the illustrated embodiments, the second drain hole 192 is configured as a slot 198 that extends longitudinally along a lower edge 88 of the display screen 90. As best illustrated in FIG. 10, a plurality of standoffs 210 support the display screen 90 relative to an interior surface 212 of the upper front panel 126 to limit water damage to the display screen 90. The illustrated standoffs 210, which are configured as a plurality of ribs, allow water to flow between the ribs, past the lower edge 88 of the display screen 90, and out from the cowling interior 106 via the second drain hole 192 along the example flow path indicated by arrow 196.

In the illustrated embodiments, the first and second drain holes 190, 192 are positioned in the front 112 of the cowling 100 so that they may drain water from the cowling interior 106 when the cowling 100 is in different trim positions. The first drain hole 190 is configured for draining water from inside the cowling interior 106 when the cowling 100 is in a full trim position, as shown in FIG. 6. The second drain hole 192 is configured for draining water from inside the cowling interior 106 when the cowling 100 is in a partial trim position between the fully raised position (FIG. 6) and the lower position (FIG. 1).

Some embodiments may include at least one drain hole that is differently shaped, sized, or positioned than those of the illustrated embodiments. For example, the first drain hole may be configured as a slot or a plurality of drain holes and/or the second drain hole may be configured as a single hole, or as a plurality of separate holes. Some embodiments may include additional drain holes in at least one of the front panels 124, 126, and some embodiments may omit at least one of the illustrated drain holes 190, 192.

Some embodiments of a cowling 100 may include features of draining water from the lower portions of the marine drive 50. For example, referring to FIG. 11, the bottom 110 of the top cowl 102 includes an opening 220 through which the extension leg 60 extends. Water may flow out of the top cowl 102 through a gap 222 between an outer surface 224 of the extension leg 60 and a rim 226 of the opening 220 along the example flow path indicated by arrows 230.

As previously mentioned, the cowling 100 includes a lower cowl 104 formed by the extension leg, 60, the head 67 of the anti-ventilation plate 68, and the stem 66. The extension leg, 60, the head 67 of the anti-ventilation plate 68, and the stem 66 each include a respective perimeter side wall 234, 236, 238 that define a hollow interior 240 of the lower cowl 104. The radially outer profiles of the extension leg 60, the head 67, and the stem 66 generally match each other, in particular such that these components together provide a smooth outer surface which is streamlined and encounters minimal hydrodynamic drag as the marine vessel travels through the water. A rigid conduit or tube 242 extends through the lower cowl interior 240 from a top end in the top cowl 102 and a bottom end received in a cylindrical stack 244 extending up from the torpedo housing 54. The radially outer surface of the tube 242 is sealed against the radially inner surface of the cylindrical stack 244, for example with an O-ring or other gasket, to prevent the ingress of water into the torpedo housing 54. The lower cowl 104 may include at least one drain hole 246 for draining water from inside the lower cowl. In the illustrated embodiments, the lower cowl 104 includes two drain holes 246 formed through the side of the lower cowl 104 proximate a bottom end 248 of the lower cowl 104. The drain holes 246 allow water to drain from inside the interior 240 of the lower cowl 104 along example flow paths indicated by arrows 247. Some embodiments, however, may include a different drain hole configuration. For example, the lower cowling may include a different number of drain holes, and/or at least one drain hole may be in a different location than those of the illustrated embodiments.

To reduce or prevent the ingress of water into the top cowl 102 via the opening 220, embodiments of a marine drive 50 may include a splash plate 250. located between the top cowl 102 and the torpedo housing 54. The illustrated splash plate 250 includes a collar 252 that abuts and extends around the outer surface 105 of the lower cowl 104 and a flange 254 which extends from and around the outer surface 105 at a top side of the collar 252. The flange 254 is configured to deflect any water traveling upwards away from the opening 220 along an example flow path indicated by arrow 256. Some embodiments may include a splash plate that is differently shaped, sized, or positioned that the illustrated splash plate 250.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A cowling for an outboard marine drive, the cowling extending from a top to a bottom in an axial direction, from a front to a rear in a longitudinal direction which is perpendicular to the axial direction, and from a port side to a starboard side in a lateral direction which is perpendicular to the axial direction and perpendicular to the longitudinal direction, the cowling comprising:

a top cowl defining a cowling interior;

a lid on the top cowl, the lid being movable into and between an open position providing access to the cowling interior and a closed position enclosing the cowling interior; and a trough system located below the lid, the trough system being configured to drain water by gravity from the lid and the top cowl.

2. The cowling according to claim 1, wherein the trough system is configured to drain the water to the port side and to the starboard side of the cowling.

3. The cowling according to claim 1, wherein the top cowl comprises an upper lip which is turned radially inwardly towards the cowling interior, and wherein the lid in the closed position overlaps the upper lip such that the upper lip provides a deflector for the water.

4. The cowling according to claim 3, wherein the trough system is at least partially defined by the upper lip.

5. The cowling according to claim 3, wherein the trough system and the upper lip are one piece.

6. The cowling according to claim 3, wherein the lid comprises a port edge portion and a starboard edge portion, wherein the port edge portion and the starboard edge portion overlap and are turned downwardly towards the port side and the starboard side of the cowling, respectively, when the lid is in the closed position.

7. The cowling according to claim 6, wherein the trough system comprises a port gutter located along the port side of the top cowl and a starboard gutter located along the starboard side of the top cowl, wherein the port gutter and the starboard gutter convey water from the lid longitudinally along the port side and the starboard side of the cowling, respectively, for removal from the cowling.

8. The cowling according to claim 7, wherein the lid, the port gutter, and the starboard gutter are sloped downwardly towards the front of the cowling such that the water drains by gravity towards the front of the cowling.

9. The cowling according to claim 8, wherein the trough system further comprises a port channel which conveys water from the port gutter downwardly along the port side of the cowling and a starboard channel which conveys water from the starboard gutter downwardly along the starboard side of the cowling.

10. The cowling according to claim 9, wherein the port channel is connected to the port gutter along the front of the cowling and wherein the starboard channel is connected to the starboard gutter along the front of the cowling.

11. The cowling according to claim 3, wherein the lid is sloped towards the front of the cowling and wherein the trough system comprises a drain gutter located at the front of the cowling, the drain gutter being configured to convey the water from the lid to the port side and the starboard side of the cowling.

12. The cowling according to claim 11, wherein the lid comprises a front edge portion over which the water on the lid in the closed position drains to the drain gutter.

13. The cowling according to claim 11, wherein the drain gutter comprises an axially extending baffle which separates the water for conveyance to the port side and the starboard side.

14. The cowling according to claim 11, wherein the top cowl comprises a front panel having a rear edge which faces a front edge portion of the lid in the closed position, and wherein a gap is defined between the rear edge and the front edge portion through which water drains to the drain gutter.

15. The cowling according to claim 14, further comprising at least one drain hole in the front panel for draining the water from inside the cowling interior when the cowling is trimmed up about a lateral trim axis.

16. The cowling according to claim 15, wherein the at least one drain hole comprises a first drain hole for draining the water from inside the cowling interior when the cowling is in a full trim position and a second drain hole for draining water from inside the cowling interior when the cowling is in a partial trim position.

17. The cowling according to claim 15, wherein the front panel is configured to support a display screen and wherein the at least one drain hole is configured to drain the water away from the display screen.

18. The cowling according to claim 17, further comprising a plurality of standoffs which support the display screen relative to an interior surface of the front panel to limit water damage to the display screen.

19. The cowling according to claim 3, wherein the cowling comprises a rear panel having a recess in which water collects when the cowling is trimmed up about a lateral trim axis, and further comprising a deflector surface configured to drain the water from the cowling when the cowling is steered out of a center position relative to a steering axis.

20. The cowling according to claim 19, wherein the deflector surface extends over the upper lip.

21. The cowling according to claim 1, wherein the top cowl comprises an upper lip which is turned radially inwardly towards the cowling interior, and wherein the lid in the closed position overlaps the upper lip such that the upper lip provides a deflector for the water;

wherein the lid comprises a port edge portion and a starboard edge portion, wherein the port edge portion and the starboard edge portion overlap and are turned downwardly towards the port side and the starboard side of the cowling respectively when the lid is in the closed position;

wherein the trough system comprises a port gutter located along the port side of the top cowl and a starboard gutter located along the starboard side of the top cowl, wherein the port gutter and the starboard gutter convey water from the lid longitudinally along the port side and the starboard side of the cowling, respectively, for removal from the cowling;

wherein the lid is sloped towards the front of the cowling and wherein the trough system comprises a drain gutter located at the front of the cowling, the drain gutter being configured to convey the water from the lid to the port side and the starboard side of the cowling; and wherein the trough system further comprises a port channel which conveys water from the port gutter downwardly along the port side of the cowling and a starboard channel which conveys water from the starboard gutter downwardly along the starboard side of the cowling.

22. An outboard marine drive which extends from a top to a bottom in an axial direction, from a front to a rear in a longitudinal direction which is perpendicular to the axial direction, and from a port side to a starboard side in a lateral direction which is perpendicular to the axial direction and perpendicular to the longitudinal direction, the outboard marine drive being steerable about an axial steering axis and being trimmable about a lateral trim axis, the outboard marine drive comprising:

a cowling comprising a top cowl defining a cowling interior;

a lid on the top cowl, the lid being movable into and between an open position providing access to the cowling interior and a closed position enclosing the cowling interior; and a trough system located below the lid, the trough system being configured to drain water by gravity from the lid and the top cowl.

23. The outboard marine drive according to claim 22, wherein the lid is sloped towards the front of the cowling and wherein the trough system comprises a drain gutter located at the front of the cowling, the drain gutter being configured to convey the water from the lid to the port side and the starboard side of the cowling.

24. The outboard marine drive according to claim 23, wherein the top cowl comprises a front panel having a rear edge which faces a front edge portion of the lid in the closed position, and wherein a gap is defined between the rear edge and the front edge portion through which water drains to the drain gutter.

25. The outboard marine drive according to claim 24, further comprising at least one drain hole in the front panel for draining the water from inside the cowling interior when the cowling is trimmed up about a lateral trim axis.

26. The outboard marine drive according to claim 25, further comprising a display screen supported on the front panel, wherein the at least one drain hole is configured to drain the water away from the display screen.

27. The outboard marine drive according to claim 22, wherein the top cowl comprises an upper lip which is turned radially inwardly towards the cowling interior, and wherein the lid in the closed position overlaps the upper lip such that the upper lip provides a deflector for the water.

28. The outboard marine drive according to claim 27, wherein the lid comprises a port edge portion and a starboard edge portion, wherein the port edge portion and the starboard edge portion overlap and are turned downwardly towards the port side and the starboard side of the cowling respectively when the lid is in the closed position;

wherein the trough system comprises a port gutter located along the port side of the top cowl and a starboard gutter located along the starboard side of the top cowl, wherein the port gutter and the starboard gutter convey water from the lid longitudinally along the port side and the starboard side of the cowling, respectively, for removal from the cowling;

wherein the lid is sloped towards the front of the cowling and wherein the trough system comprises a drain gutter located at the front of the cowling, the drain gutter being configured to convey the water from the lid to the port side and the starboard side of the cowling; and wherein the trough system further comprises a port channel which conveys water from the port gutter downwardly along the port side of the cowling and a starboard channel which conveys water from the starboard gutter downwardly along the starboard side of the cowling.

29. The outboard marine drive according to claim 22, further comprising a torpedo housing for supporting a propulsor, and a lower cowl located between the top cowl and the torpedo housing, the lower cowl comprising at least one drain hole for draining water from inside the lower cowl.

30. The outboard marine drive according to claim 22, further comprising a torpedo housing for supporting a propulsor, a lower cowl located between the top cowl and the torpedo housing, and a splash plate extending around the lower cowl.

* * * * *